US008985725B2

(12) United States Patent
Mizes et al.

(10) Patent No.: US 8,985,725 B2
(45) Date of Patent: Mar. 24, 2015

(54) METHOD AND APPARATUS FOR ALIGNMENT OF A LOW CONTRAST INK PRINTHEAD IN AN INKJET PRINTER

(71) Applicant: Xerox Corporation, Norwalk, CT (US)

(72) Inventors: Howard A. Mizes, Pittsford, NY (US); Joseph C. Sheflin, Macedon, NY (US); Michael J. Levy, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 4 days.

(21) Appl. No.: 13/680,493

(22) Filed: Nov. 19, 2012

(65) Prior Publication Data

US 2014/0139578 A1 May 22, 2014

(51) Int. Cl.

| | |
|---|---|
| ***B41J 29/38*** | (2006.01) |
| ***B41J 29/393*** | (2006.01) |
| ***B41J 3/54*** | (2006.01) |
| ***B41J 2/21*** | (2006.01) |

(52) U.S. Cl.

CPC ..... *B41J 3/543* (2013.01); *B41J 2/2146* (2013.01)

USPC ..... 347/14; 347/19

(58) Field of Classification Search

CPC ..... B41J 29/393

USPC ..... 347/14, 19

See application file for complete search history.

(56) References Cited

U.S. PATENT DOCUMENTS

| | | | | |
|---|---|---|---|---|
| 5,398,131 | A | 3/1995 | Hall et al. | |
| 5,631,686 | A * | 5/1997 | Castelli et al. | 347/133 |
| 5,898,443 | A | 4/1999 | Yoshino et al. | |
| 6,210,776 | B1 | 4/2001 | Hill | |
| 6,267,052 | B1 | 7/2001 | Hill et al. | |
| 6,378,976 | B1 | 4/2002 | Byers et al. | |
| 6,454,383 | B2 | 9/2002 | Lund et al. | |
| 6,899,775 | B2 | 5/2005 | Hill et al. | |
| 6,983,686 | B2 | 1/2006 | Vaughn et al. | |
| 6,994,413 | B2 | 2/2006 | Otsuka et al. | |
| 7,101,017 | B2 | 9/2006 | Endo et al. | |
| 7,113,615 | B2 | 9/2006 | Rhoads et al. | |
| 7,318,637 | B2 | 1/2008 | Ishimoto et al. | |
| 7,533,982 | B2 | 5/2009 | Yoneyama | |
| 7,621,614 | B2 | 11/2009 | Endo | |
| 7,690,746 | B2 | 4/2010 | Mantell et al. | |
| 2002/0113968 | A1 * | 8/2002 | Parisi et al. | 356/399 |
| 2004/0258274 | A1 | 12/2004 | Brundage et al. | |
| 2006/0249039 | A1 | 11/2006 | Feldman et al. | |
| 2008/0211866 | A1 | 9/2008 | Hill | |
| 2009/0220750 | A1 | 9/2009 | Hill et al. | |
| 2009/0237434 | A1 | 9/2009 | Mantell et al. | |
| 2009/0267975 | A1 | 10/2009 | White et al. | |
| 2010/0112223 | A1 | 5/2010 | Hill | |
| 2011/0110567 | A1 * | 5/2011 | Jiang | 382/128 |
| 2011/0242187 | A1 * | 10/2011 | Mongeon et al. | 347/19 |
| 2011/0249051 | A1 * | 10/2011 | Chretien et al. | 347/14 |

* cited by examiner

*Primary Examiner* — Geoffrey Mruk
*Assistant Examiner* — Scott A Richmond
(74) *Attorney, Agent, or Firm* — Maginot Moore & Beck LLP

(57) ABSTRACT

In an inkjet printer, a first printhead forms a first mark on a print medium using a high-contrast ink. A second printhead forms a second mark on the first mark using a low-contrast ink. The printer generates image data of the low-contrast ink mark and the high-contrast ink, and a controller in the printer identifies a cross-process direction offset between the first printhead and the second printhead with reference to a distance between the center of the first mark and the second mark in the image data.

16 Claims, 8 Drawing Sheets

METHOD AND APPARATUS FOR ALIGNMENT OF A LOW CONTRAST INK PRINTHEAD IN AN INKJET PRINTER

TECHNICAL FIELD

The system and method disclosed in this document relates to inkjet printing systems generally, and, more particularly, to systems and methods for aligning printheads to enable ink drop registration in inkjet printing systems.

BACKGROUND

Inkjet printers have printheads that operate a plurality of inkjets to eject liquid ink onto an image receiving member. The ink may be stored in reservoirs located within cartridges installed in the printer. Such ink may be aqueous, oil, solvent-based, UV curable ink, or an ink emulsion. Other inkjet printers receive ink in a solid form and then melt the solid ink to generate liquid ink for ejection onto the imaging member. In these solid ink printers, the solid ink may be in the form of pellets, ink sticks, granules or other shapes. The solid ink pellets or ink sticks are typically placed in an ink loader and delivered through a feed chute or channel to a melting device that melts the ink. The melted ink is then collected in a reservoir and supplied to one or more printheads through a conduit or the like. In other inkjet printers, ink may be supplied in a gel form. The gel is also heated to a predetermined temperature to alter the viscosity of the ink so the ink is suitable for ejection by a printhead.

A typical full width scan inkjet printer uses one or more printheads. Each printhead typically contains an array of individual nozzles for ejecting drops of ink across an open gap to an image receiving member to form an image. The image receiving member may be a continuous web of recording media, a series of media sheets, or the image receiving member may be a rotating surface, such as a print drum or endless belt. Images printed on a rotating surface are later transferred to recording media by mechanical force in a transfix nip formed by the rotating surface and a transfix roller. In an inkjet printhead, individual piezoelectric, thermal, or acoustic actuators generate mechanical forces that expel ink through an orifice from an ink filled conduit in response to an electrical voltage signal, sometimes called a firing signal. The amplitude, frequency, or duration of the signals affects the amount of ink ejected in each drop. The firing signal is generated by a printhead controller with reference to electronic image data. An inkjet printer forms an ink image on an image receiving surface with reference to the electronic image data by printing a pattern of individual ink drops at particular locations on the image receiving surface. The locations where the ink drops landed are sometimes called "ink drop locations," "ink drop positions," or "pixels." Thus, a printing operation can be viewed as the placement of ink drops on an image receiving surface with reference to electronic image data.

In order for the printed ink images to correspond closely to the image data, both in terms of fidelity to the image objects and the colors represented by the image data, the printheads must be registered with reference to the imaging surface and with the other printheads in the printer. Registration of printheads is a process in which the printheads are operated to eject ink in a known pattern and then the printed image of the ejected ink is analyzed to determine the orientation of the printhead with reference to the imaging surface and with reference to the other printheads in the printer. Operating the printheads in a printer to eject ink in correspondence with image data presumes that the printheads are level with a width across the image receiving member and that all of the inkjet ejectors in the printhead are operational. The presumptions regarding the orientations of the printheads, however, cannot be assumed, but must be verified. Additionally, if the conditions for proper operation of the printheads cannot be verified, the analysis of the printed image should generate data that can be used either to adjust the printheads so they better conform to the presumed conditions for printing or to compensate for the deviations of the printheads from the presumed conditions.

Analysis of printed images is performed with reference to two directions. "Process direction" refers to the direction in which the image receiving member is moving as the imaging surface passes the printhead to receive the ejected ink and "cross-process direction" refers to the direction across the width of the image receiving member. In order to analyze a printed image, a test pattern needs to be generated so determinations can be made as to whether the inkjets operated to eject ink did, in fact, eject ink and whether the ejected ink landed where the ink would have landed if the printhead was oriented correctly with reference to the image receiving member and the other printheads in the printer.

Systems and methods exist for detecting ink drops ejected by different printheads, inferring the positions and orientations of the printheads, and identifying correctional data useful for moving one or more of the printheads to achieve alignment acceptable for good registration in the printing system. The ink drops are ejected in a known pattern, sometimes called a test pattern, to enable one or more processors in the printing system to analyze image data of the test pattern on the ink receiving surface for detection of the ink drops and determination of the printhead positions and orientation. In some inkjet printing systems, printheads are configured to eject a transparent ink onto the ink receiving surface. This transparent ink is useful for adjusting gloss levels of the final printed product and to provide a protective layer over printed areas, if desired. One issue that arises from the use of transparent ink, however, is the difficulty in detecting drops of transparent ink ejected onto an ink receiving surface with an imaging system. Because the transparent inks do not present contrasts with the image receiving surface or other colors ejected by the printer, the known systems and methods for aligning printheads do not enable the transparent ink drops to be detected and the positions and orientations of the printheads ejecting transparent ink to be inferred. Therefore, development of a system and method for aligning printheads that eject transparent ink is a desirable goal.

SUMMARY

In one embodiment, a method of operating an inkjet printer to register a low-contrast ink printhead in a cross-process direction has been developed. The method includes operating a plurality of inkjets in a first printhead to eject a plurality of ink drops of a high-contrast ink onto an image receiving surface to cover an area of the image receiving surface having a first predetermined width in a cross-process direction, operating a plurality of inkjets in a second printhead to eject a plurality of ink drops of a low-contrast ink onto the area covered with the plurality of the high-contrast ink drops, the low-contrast ink drops being ejected within an area having a second predetermined width in the cross-process direction that is less than the first predetermined width, generating image data corresponding to a portion of the image receiving surface, identifying a position corresponding to the plurality of high-contrast ink drops in the cross-process direction with reference to the generated image data, identifying a position corresponding to the plurality of low-contrast ink drops in the cross-process direction with reference to the generated image data, identifying a cross-process direction offset between the first printhead and the second printhead with reference to a cross-process direction distance between the identified position of the plurality of the high-contrast ink drops and the identified position of the plurality of low-contrast ink drops, and operating an actuator to move the second printhead with reference to the identified cross-process direction offset.

In another embodiment, a method of operating an inkjet printer to register a low-contrast ink printhead in a process direction has been developed. The method includes operating a plurality of inkjets in a first printhead to form a strip comprised of ink drops of a high-contrast ink and to form a plurality of areas of the high-contrast ink drops outside of the strip on an image receiving surface, the strip having a first predetermined width in a cross-process direction and a length in a process direction that is longer than the first predetermined width, and each area of the high-contrast ink having a second predetermined width and being separated from another area of the high-contrast ink in the process direction by a predetermined length, operating a plurality of inkjets in a second printhead to form a plurality of areas of a low-contrast ink within the strip, each area of the low-contrast ink in the strip having the second predetermined width and being separated from another area of the low-contrast ink in the strip in the process direction by the high-contrast ink drops not covered by the low-contrast ink, generating image data of a portion of the image receiving surface using a plurality of detectors arranged in a cross-process direction across the image receiving surface, identifying a first profile for each detector generating image data for a portion of the strip having the predetermined length in the process direction and in which the low-contrast ink has been ejected, identifying a second profile for each detector generating image data for a portion of the image receiving surface having the predetermined length in the process direction and in which the high-contrast ink has been ejected, identifying a phase of the first profile and a phase of the second profile, identifying a process direction offset between the first printhead and the second printhead with reference to the identified phase of the first profile and the identified phase of the second profile, and operating at least one of the first printhead and the second printhead with reference to the identified process direction offset.

In another embodiment, an inkjet printer that is configured to register a low-contrast ink printhead has been developed. The printer includes a media path configured to move a print medium in a process direction past a first printhead and a second printhead in a print zone, an actuator associated with the second printhead and configured to move the second printhead in a cross-process direction, an optical sensor including a plurality of optical detectors configured to detect light reflected from the print medium, the optical sensor being located on the media path from the first printhead and the second printhead in the process direction with the plurality of detectors being arranged in the cross-process direction, and a controller operatively connected to the media path, the first printhead, the second printhead, the actuator, and the optical sensor. The controller is configured to operate a plurality of inkjets in the first printhead to eject a plurality of ink drops of a high-contrast ink onto the print medium to cover an area of the print medium having a first predetermined width in the cross-process direction, operate a plurality of inkjets in the second printhead to eject a plurality of ink drops of a low-contrast ink onto the area covered with the plurality of the high-contrast ink drops, the low-contrast ink drops being ejected within an area having a second predetermined width in the cross-process direction that is less than the first predetermined width, generate image data corresponding to a portion of the image receiving surface with the optical sensor, identify a position corresponding to the plurality of high-contrast ink drops in the cross-process direction with reference to the generated image data, identify a position corresponding to the plurality of low-contrast ink drops in the cross-process direction with reference to the generated image data, identify a cross-process direction offset between the first printhead and the second printhead with reference to a cross-process direction distance between the identified position of the plurality of ink drops of the high-contrast ink and the identified position of the plurality of the low-contrast ink drops, and operate the actuator to move the second printhead with reference to the identified cross-process direction offset.

BRIEF DESCRIPTION OF THE DRAWINGS

An exemplary embodiment of this application is described below, by way of example, with reference to the accompanying drawings, in which like reference numerals refer to like elements.

DETAILED DESCRIPTION

Figure 1:
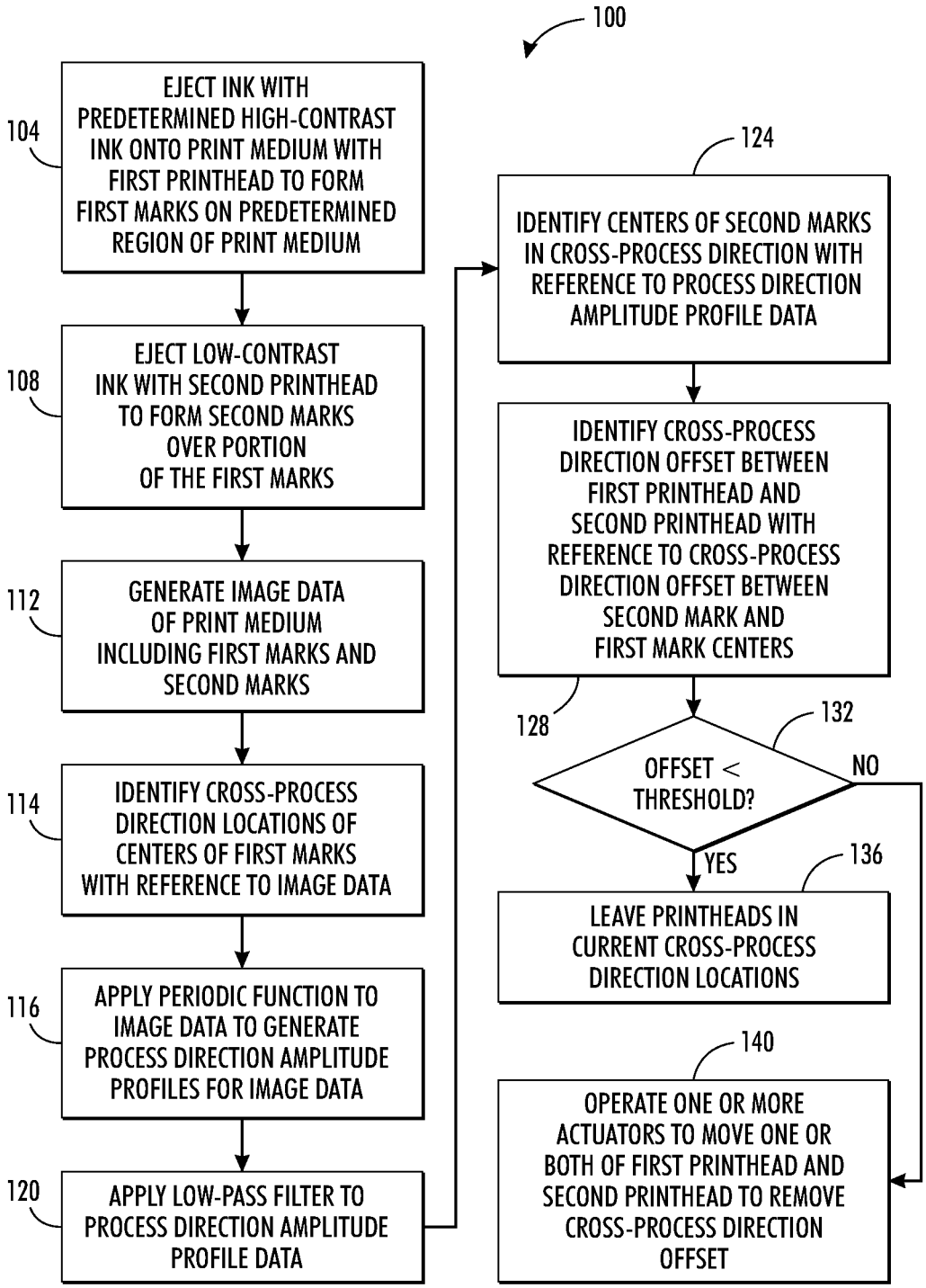
FIG. 1 is a block diagram of a process for performing cross-process direction registration between printheads that print a low-contrast ink and printheads that print a high-contrast ink.

For a general understanding of the environment for the system and method disclosed herein as well as the details for the system and method, reference is made to the drawings. In the drawings, like reference numerals have been used throughout to designate like elements. As used herein, the word "printer" encompasses any apparatus that produces images with colorants on media, such as digital copiers, bookmaking machines, facsimile machines, multi-function machines, and the like. As used herein, the term "process direction" refers to a direction of movement of a print medium, such as a continuous media web pulled from a roll of paper or other suitable print medium along a media path through a printer. The print medium moves past one or more printheads in the print zone to receive ink images and passes other printer components, such as heaters, fusers, pressure rollers, and on-sheet imaging sensors, that are arranged along the media path. As used herein, the term "cross-process" direction refers to an axis that is perpendicular to the process direction along the surface of the print medium.

As used herein, the term "phase change ink" refers to a form of ink that is substantially solid at room temperature and transitions to a liquid state when heated to a phase change ink melting temperature for ejecting onto the image receiving member surface. The phase change ink melting temperature is any temperature that is capable of melting solid phase change ink into liquid or molten form. The phase change ink returns to the solid state after cooling on a print medium, such as paper, to form a printed image on the print medium.

As used herein, the term "ink color" refers to any type of ink that has a visible color when printed on a print medium such as paper. For example, a cyan, magenta, yellow, and black (CMYK) printer uses the four CMYK ink colors to form printed images on a white paper print medium. Various types of ink, including aqueous inks, solvent based inks, and phase change inks, are formulated with a wide range of ink colors.

As used herein, the term "low-contrast" ink refers to any ink that has a low visual contrast compared to the underlying image receiving surface when printed directly onto an image receiving surface. For example, image data generated from the image receiving surface including the low-contrast ink do not clearly distinguish between the low-contrast ink and the underlying surface. One type of low-contrast ink that has a low-contrast for a wide range of image receiving surfaces is a transparent ink. As used herein, the term "transparent ink" refers to an ink that is substantially transparent when formed on a print medium. In some print modes, the transparent ink is printed over an ink with a visible color to affect the glossiness of the printed image or to form a protective layer over the visible ink.

While transparent inks are a one form of low-contrast ink, other types of ink that are typically visible to the naked eye are also low-contrast inks in some printing configurations. For example, some printers form printed images on brown packaging paper. In a CMYK ink printer, the yellow ink drops have a low-contrast on the brown packaging paper, which makes detection of the yellow ink drops on the bare brown paper difficult. In another configuration, the printer forms printed images on a black carbon paper or other dark material where the black ink has a low-contrast on the underlying print medium.

As used herein, the term "high-contrast ink" refers to an ink that has a high-contrast compared to an underlying image receiving surface. For example, black ink printed on white paper has a high-contrast. As described below, a printer forms marks of an appropriate high-contrast ink on the image receiving surface and marks of a low-contrast ink are printed over the high-contrast ink marks to enable the optical sensors in the printer to identify the locations of the low-contrast ink marks when performing cross-process direction and process direction printhead registration.

As used herein, the term "scanline" refers to a single row of pixels of image data that are generated by a plurality of optical detectors in an optical sensor that is arranged in the cross-process direction across a media path. The detectors in the optical sensor are configured to detect light reflected from the image receiving surface and ink marks that are formed on the image receiving surface. In a single imaging operation, the optical sensor 54 generates the scanline including a one-dimensional row of image data pixels that correspond to a narrow section of the surface of the image receiving surface extending in the cross-process direction. Each optical detector in the optical sensor generates a single pixel in the scanline.

As used herein, the term "pixel column" refers to a series of pixels that are generated by a single optical detector in an optical sensor that detects light reflected from a small portion of the image receiving surface. As the image receiving surface moves past the optical sensor, the optical detector continues to generate pixels of image data to form a one-dimensional pixel column that extends in the process direction. Since the optical sensor includes a plurality of optical detectors, the optical sensor generates two-dimensional image data from a series of scanlines where each detector generates a single pixel in each scanline and the successive pixels generated by each detector form pixel columns.

Figure 7:
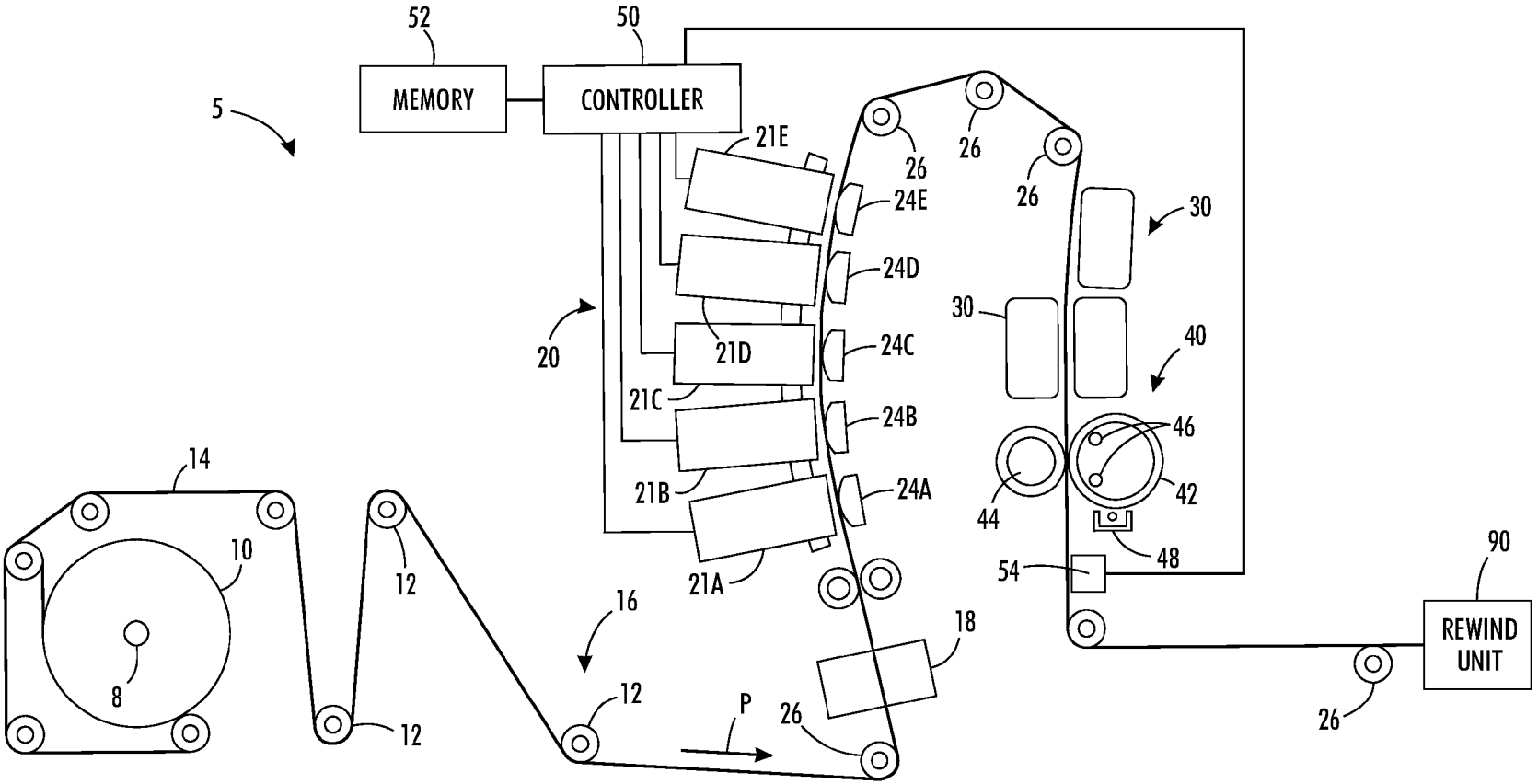
FIG. 7 PRIOR ART
FIG. 7 is a prior art schematic diagram of a continuous feed inkjet printer.

FIG. 7 depicts a prior-art inkjet printer 5. For the purposes of this disclosure, an inkjet printer employs one or more inkjet printheads to eject drops of ink onto a surface of an image receiving member, such as paper, another print medium, or an indirect member, such as a rotating image drum or belt. The phase change ink melting temperature is any temperature that is capable of melting solid phase change ink into liquid or molten form. In one embodiment, the phase change ink melting temperature is approximately 70° C. to 140° C. The printer 5 is configured to print ink images with a "phase change ink," by which is meant an ink that is substantially solid at room temperature and which transitions to a liquid state when heated to a phase change ink melting temperature for ejecting onto the surface of the image receiving member. In the printer 5, each of the printhead units 21A-21E includes a plurality of printheads with each printhead having a plurality of inkjets that eject liquid drops of the phase change ink of different colors onto the media web 14. The phase change inks cool and solidify on the media web 14 after passing through a fixing assembly 40 that is described in more detail below. In alternative embodiments, the ink utilized in the printer comprises UV curable gel ink. Gel inks are also heated before being ejected by the inkjet ejectors of the printhead. As used herein, liquid ink refers to melted solid ink, heated gel ink, or other known forms of ink, such as aqueous inks, ink emulsions, ink suspensions, ink solutions, or the like.

The printer 5 includes a controller 50 to process the image data before generating the control signals for the inkjet ejectors to eject colorants. Colorants can be ink or any suitable substance, which includes one or more dyes or pigments and which is applied to the media. The colorant can be black or any other desired color, and some printer configurations apply a plurality of different colorants to the media. The media includes any of a variety of substrates, including plain paper, coated paper, glossy paper, or transparencies, among others, and the media can be available in sheets, rolls, or other physical formats.

The printer 5 is an example of a direct-to-web, continuous-media, phase change inkjet printer that includes a media supply and handling system configured to supply a long (i.e., substantially continuous) web of media 14 of "substrate" (paper, plastic, or other printable material) from a media source, such as spool of media 10 mounted on a web roller 8. The media web 14 includes a large number (e.g. thousands or tens of thousands) of individual pages that are separated into individual sheets with commercially available finishing devices after completion of the printing process. In the example of FIG. 7, the media web 14 is divided into a plurality of forms that are delineated with a series of form indicators that are arranged at predetermined intervals on the media web 14 in the process direction. Some webs include perforations that are formed between pages in the web to promote efficient separation of the printed pages.

In the printer 5, the media web 14 is unwound from the source 10 as needed and a variety of motors, not shown, rotate one or more rollers 12 and 26 to propel the media web 14. The media conditioner includes rollers 12 and a pre-heater 18. The rollers 12 and 26 control the tension of the unwinding media as the media moves along a path through the printer. In alternative embodiments, the printer transports a cut sheet media through the print zone in which case the media supply and handling system includes any suitable device or structure to enable the transport of cut media sheets along a desired path through the printer. The pre-heater 18 brings the web to an initial predetermined temperature that is selected for desired image characteristics corresponding to the type of media being printed as well as the type, colors, and number of inks being used. The pre-heater 18 can use contact, radiant, conductive, or convective heat to bring the media to a target preheat temperature, which in one practical embodiment, is in a range of about 30° C. to about 70° C.

The media web 14 continues in the process direction P through the print zone 20 past a series of printhead units 21A, 21B, 21C, 21D, and 21E. Each of the printhead units 21A-21E effectively extends across the width of the media and includes one or more printheads that eject ink directly (i.e., without use of an intermediate or offset member) onto the media web 14. In printer 5, each of the printheads ejects a single color of ink, one for each of the colors typically used in color printing, namely, cyan, magenta, yellow, and black (CMYK). The print zone 20 also includes a printhead unit 21E that includes an array of printheads that eject transparent ink onto the media web 14 and onto ink drops that are ejected from the other inkjets in the printhead units 21A-21D. In the printer 5, the printhead unit 21E is configured in substantially the same manner as each of the printhead units 21A-21D, but the printhead unit 21E ejects transparent ink instead of the CMYK colors of the printheads in the printhead units 21A-21D.

The controller 50 of the printer 5 receives velocity data from encoders mounted proximately to the rollers positioned on either side of the portion of the path opposite the four printheads to calculate the linear velocity and position of the web as the web moves past the printheads. The controller 50 uses the media web velocity data to generate firing signals for actuating the inkjet ejectors in the printheads to enable the printheads to eject four colors of ink with appropriate timing and accuracy for registration of the differently colored patterns to form color images on the media. The inkjet ejectors actuated by the firing signals correspond to digital data processed by the controller 50. The digital data for the images to be printed can be transmitted to the printer, generated by a scanner (not shown) that is a component of the printer, or otherwise generated and delivered to the printer.

Associated with each printhead unit is a backing member 24A-24E, typically in the form of a bar or roll, which is arranged substantially opposite the printhead on the back side of the media. Each backing member positions the media at a predetermined distance from the printhead opposite the backing member. The backing members 24A-24E are optionally configured to emit thermal energy to heat the media to a predetermined temperature, which is in a range of about 40° C. to about 60° C. in printer 5. The various backer members can be controlled individually or collectively. The pre-heater 18, the printheads, backing members 24A-24E (if heated), as well as the surrounding air combine to maintain the media along the portion of the path opposite the print zone 20 in a predetermined temperature range of about 40° C. to 70° C.

As the partially-imaged media web 14 moves to receive inks of various colors from the printheads of the print zone 20, the printer 5 maintains the temperature of the media web 14 within a given range. The printheads in the printhead units 21A-21E eject phase change inks at a temperature typically significantly higher than the temperature of the media web 14. Consequently, the ink heats the media, and temperature control devices can maintain the media web temperature within a predetermined range. For example, the air temperature and air flow rate behind and in front of the media web 14 impacts the media temperature. Accordingly, air blowers or fans can be utilized to facilitate control of the media temperature. Thus, the printer 5 maintains the temperature of the media web 14 within an appropriate range for the jetting of all inks from the printheads of the print zone 20. Temperature sensors (not shown) can be positioned along this portion of the media path to enable regulation of the media temperature.

Following the print zone 20 along the media path are one or more "mid-heaters" 30. A mid-heater 30 can use contact, radiant, conductive, and/or convective heat to control a temperature of the media. The mid-heater 30 brings the ink placed on the media to a temperature suitable for desired properties when the ink on the media is sent through the spreader 40. In one embodiment, a useful range for a target temperature for the mid-heater is about 35° C. to about 80° C. The mid-heater 30 has the effect of equalizing the ink and substrate temperatures to within about 15° C. of each other. Lower ink temperature gives less line spread while higher ink temperature causes show-through (visibility of the image from the other side of the print). The mid-heater 30 adjusts substrate and ink temperatures to 0° C. to 20° C. above the temperature of the spreader.

Following the mid-heaters 30, a fixing assembly 40 applies heat and/or pressure to the media to fix the images to the media. The fixing assembly includes any suitable device or apparatus for fixing images to the media including heated or unheated pressure rollers, radiant heaters, heat lamps, and the like. In the embodiment of the FIG. 7, the fixing assembly includes a "spreader" 40, which applies a predetermined pressure, and in some implementations, heat, to the media. The function of the spreader 40 is to flatten the individual ink droplets, strings of ink droplets, or lines of ink on web 14 with pressure and, in some systems, heat. The spreader flattens the ink drops to fill spaces between adjacent drops and form uniform images on the media web 14. In addition to spreading the ink, the spreader 40 improves fixation of the ink image to the media web 14 by increasing ink layer cohesion and/or increasing the ink-web adhesion. The spreader 40 includes rollers, such as image-side roller 42 and pressure roller 44, to apply heat and pressure to the media. Either roll can include heat elements, such as heating elements 46, to bring the web 14 to a temperature in a range from about 35° C. to about 80° C. In alternative embodiments, the fixing assembly spreads the ink using non-contact heating (without pressure) of the media after the print zone 20. Such a non-contact fixing assembly can use any suitable type of heater to heat the media to a desired temperature, such as a radiant heater, UV heating lamps, and the like.

In one practical embodiment, the roller temperature in spreader 40 is maintained at an optimum temperature that depends on the properties of the ink, such as 55° C. Generally, a lower roller temperature gives less line spread while a higher temperature produces imperfections in the gloss of the ink image. Roller temperatures that are too high may cause ink to offset to the roll. In one practical embodiment, the nip pressure is set in a range of about 500 to about 2000 psi lbs/side. Lower nip pressure produces less line spread while higher pressure may reduce pressure roller life.

The spreader 40 can include a cleaning/oiling station 48 associated with image-side roller 42. The station 48 cleans and/or applies a layer of some release agent or other material to the roller surface. The release agent material can be an amino silicone oil having viscosity of about 10-200 centipoises. A small amount of oil transfers from the station to the media web 14, with the printer 5 transferring approximately 1-10 mg per A4 sheet-sized portion of the media web 14. In one embodiment, the mid-heater 30 and spreader 40 are combined into a single unit with their respective functions occurring relative to the same portion of media simultaneously. In another embodiment, the media is maintained at a high temperature as the media exits the print zone 20 to enable spreading of the ink.

The printer 5 includes an optical sensor 54 that is configured to generate multiple scanlines of image data corresponding to the surface of the media web 14. The optical sensor 54 is configured to detect, for example, the presence, reflectance values, and/or location of ink drops jetted onto the media web 14 by the inkjets of the printhead assembly. The optical sensor 54 includes an array of optical detectors mounted to a bar or other longitudinal structure that extends across the width of an imaging area on the image receiving member. In one embodiment in which the imaging area is approximately twenty inches wide in the cross-process direction and the printheads print at a resolution of 600 dpi in the cross-process direction, over 12,000 optical detectors are arrayed in a single row along the bar to generate a single scanline of image data corresponding to a line across the image receiving member. The controller 50 generates two-dimensional image data from a series of scanlines that the optical sensor 54 generates as the media web 14 move past the optical sensor 54. The optical detectors are configured in association in one or more light sources that direct light towards the surface of the media web 14. The optical detectors receive the light generated by the light sources after the light is reflected from the image receiving member. The magnitude of the electrical signal generated by an optical detector corresponds to an amount of reflected light received by the detector from the bare surface of the media web 14 or ink markings formed on the media web 14. The magnitudes of the electrical signals generated by the optical detectors are converted to digital values by an appropriate analog/digital converter.

In printer 5, the controller 50 is operatively connected to various subsystems and components to regulate and control operation of the printer 5. The controller 50 is implemented with general or specialized programmable processors that execute programmed instructions. The instructions and data required to perform the programmed functions are stored in a memory 52 that is associated with the controller 50. The memory 52 stores programmed instructions for the controller 50. The memory 52 also stores cross-process direction registration data between the printheads in each of the printhead units 21A-21E and process direction timing offset data for the printheads in each of the printhead units 21A-21E.

In the controller 50, the processors, their memories, and interface circuitry configure the controllers and/or print zone to perform the printer operations. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits. The controller 50 is operatively connected to the printheads in the printhead units 21A-21E. The controller 50 generates electrical firing signals to operate the individual inkjets in the printhead units 21A-21D to eject ink drop with the CMYK colors that form printed images on the media web 14, and generates electrical firing signals to operate the individual inkjets in the printhead units 21E to eject transparent ink drops onto the media web 14. As described in more detail below, the controller 50 performs cross-process direction and process direction registration to align the printheads and inkjets in the transparent ink printhead unit 21E with corresponding printheads in each of the printhead units 21A-21D to produce high quality printed images on the media web 14.

FIG. 1 depicts a process 100 for cross-process direction registration of printheads in a print zone that includes printheads that print ink having a visible color and printheads that print a transparent ink. In the discussion below, a reference to the process 100 performing a function or action refers to a controller executing programmed instructions stored in a memory to operate one or more components in a printer to perform the function or action. Process 100 is described in conjunction with the printer 5 for illustrative purposes.

Process 100 begins as inkjets in a first printhead that prints a predetermined color of ink ejects a plurality of ink drops onto an image receiving surface to form a first mark having the predetermined color (block 104). In the printer 5, inkjets in one of the printheads in the printhead unit 21D eject ink drops of black ink that form marks on the media web 14. In the illustrative embodiment of the printer 5, the media web 14 is white paper and the black ink is a high-contrast ink that is easily detectable on the surface of the white paper. Process 100 continues as a corresponding printhead in the printhead unit 21E ejects transparent ink drops onto the marks that are formed on the media web 14 (block 108).

Figure 3A:
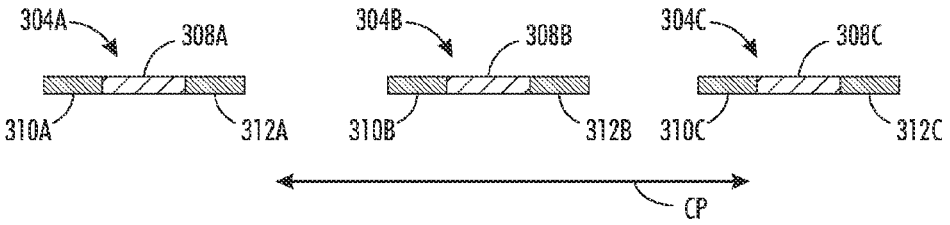
FIG. 3A is a depiction of a test pattern including low-contrast ink marks formed over a high-contrast ink for cross-process direction printhead registration.

FIG. 3A depicts one configuration of marks that includes the marks with the predetermined ink color and the marks formed with the transparent ink. In FIG. 3A, the black ink printhead prints a series of line segments 304A, 304B, and 304C that extend in the cross-process direction CP, and the transparent ink printhead prints transparent ink segments 308A, 308B, and 308C. The media web 14 passes the black ink printhead in the printhead unit 21D in the print zone 20 prior to passing the transparent printhead in the printhead unit 21E, so the black ink marks 304A-304C are formed on the media web 14 prior to the transparent ink marks 308A-308C. The black ink printhead forms the line segments 304A-304C with a wider width in the cross-process direction CP than the transparent ink segments 308A-308C. In particular, each of the black ink marks 304A-304C includes a left-side margin 310A-310C and right-side margin 312A-312C, respectively. In the embodiment of FIG. 3A, the size for each of the left-side and right-side margins is larger than a maximum expected offset between the black ink printhead and transparent ink printhead in the cross-process direction CP.

Figure 3B:
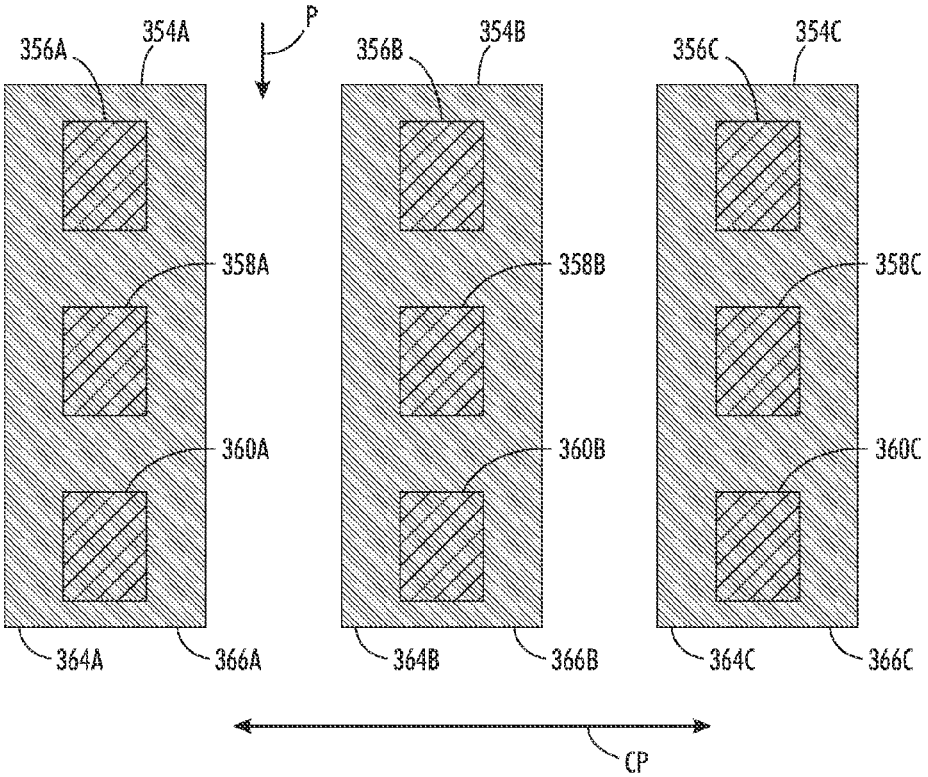
FIG. 3B is another depiction of a test pattern including low-contrast ink marks formed over a high-contrast ink for cross-process direction printhead registration.

FIG. 3B depicts another configuration of marks that includes the ink with the predetermined color and the transparent ink. In FIG. 3B, the inkjets in the black ink printhead eject ink drops to form printed strips 354A, 354B, and 354C that have a predetermined width in the cross-process direction CP and a predetermined length in the process direction P, where the length is longer than the width in the example of FIG. 3B. The transparent ink printhead forms a series of printed marks, such as squares or rectangles, over each of the printed strips. For example, in FIG. 3B, the marks 356A, 358A, and 360A are printed on the strip 354A; marks 356B, 358B, and 360B are formed on the strip 354B; and marks 356C, 358C, and 360C are formed on the strip 354C. The width of each of the strips 354A-354C is greater than the corresponding widths of the transparent ink marks formed on each strip with left-side margins 364A-364C and right-side margins 366A-366C that each exceed the expected maximum cross-process direction offset between the black ink printhead and the transparent ink printhead.

Both FIG. 3A and FIG. 3B depict the ink marks after the media web 14 has passed through the spreader 40 to spread the black and transparent phase change inks on the surface of the media web 14. In the printer 5, the first marks are formed with black ink since the reflectivity of black ink has a higher contrast with an image receiving surface, such as a paper print medium, and therefore any change in the reflectance due to an interaction between the transparent ink and the black ink produces a larger amplitude signal than the other CMY ink colors. Alternative embodiments use other ink colors to form the first marks, however. Each of the figures FIG. 3A and FIG. 3B illustrates three groups of marks that are formed by the black ink and transparent ink printheads to enable averaging of the mark locations in the cross-process direction for improved printhead registration. Alternative embodiments, however, form a different number of marks on the image receiving surface.

Figure 4:
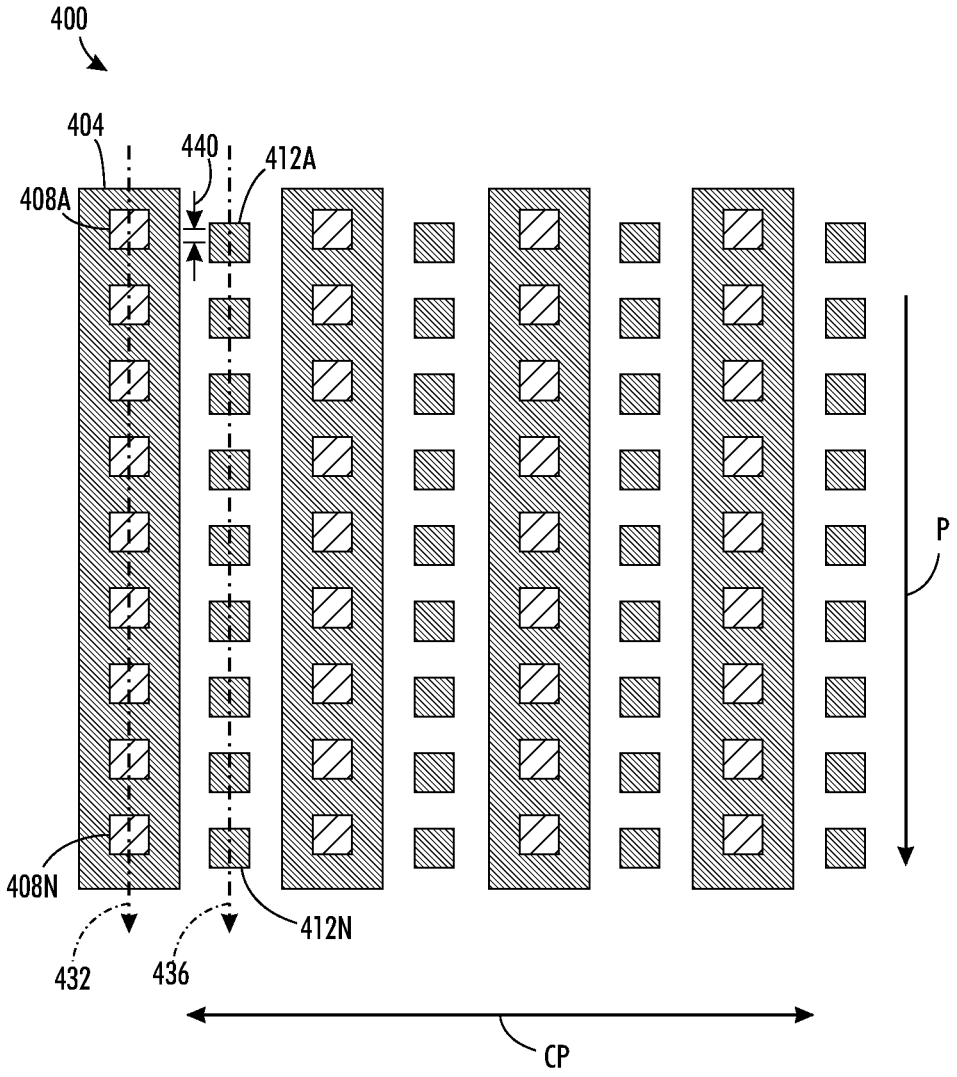
FIG. 4 is another depiction of a test pattern including low-contrast ink marks formed over a high-contrast ink for either or both of process direction and cross-process direction printhead registration.

FIG. 4 depicts another configuration of the marks 400 that the printheads form during both the cross-process direction printhead registration process 100 and a process direction registration process that is described below in more detail. FIG. 4 includes a plurality of strips, such as the strip 404, and a plurality of rectangular mark series, such as rectangular marks 412A-412N that are arranged in the process direction P. The strip 404 and the marks 412A-412N are formed from black ink in one embodiment, although alternative embodiments use different ink colors to form the first marks. In FIG. 4, each series of transparent ink marks, such as ink marks 408A-408N, is printed on one of the strips of high-contrast ink to improve the contrast in image data generated for the transparent ink marks. The strip 404 has a width in the cross-process direction CP that is wider than the width of each of the transparent ink marks 408A-408N, and a length in the process direction P that is longer than the series of the transparent ink marks 408A-408N.

In one embodiment, the cross-process direction offset between the transparent ink printhead and the black ink printhead is identified by finding the distance between the centers of the transparent ink marks, such as the marks 408A-408N, and the center of the corresponding black ink strip, such as the strip 404, in the same manner as described above in FIG. 3B. In another embodiment, the cross-process direction offset between the transparent ink printhead and the black ink printhead is identified with reference to an identified distance between the identified centers of the black ink marks, such as the marks 412A-412N, and the corresponding transparent ink marks, such as marks 408A-408N, in the cross-process direction. The centers of the transparent ink marks and black ink marks are separated by a predetermined distance in the cross-process direction, and an identified deviation from the predetermined distance indicates the magnitude and direction of an offset between the transparent ink printhead and black ink printhead.

Referring again to FIG. 1, process 100 continues as the controller 50 operates the optical sensor 54 to generate image data of a portion of the media web including the black and transparent ink marks (block 112). In the printer 5, the media web 14 passes through the spreader 40 that applies pressure and optionally heat to spread the phase change black ink and transparent ink on the surface of the media web 14. The optical sensor 54 is located along the media path after the spreader 40 in the process direction P to generate image data corresponding to the spread printed marks. In an alternative embodiment, an optical sensor generates the image data of the printed color ink drops and transparent ink drops before the media web passes through a spreader.

In a single imaging operation, the optical sensor 54 generates a single row of image data pixels, corresponding to a narrow section of the surface of the media web 14 extending in the cross-process direction. Each row of pixels is referred to as a "scan line" in the image data. Each optical detector in the optical sensor 54 generates a single pixel in the scanline. As the media web 14 moves past the optical sensor 54, the optical sensor 54 continues to generate additional scanlines to form a two-dimensional array of image data pixels formed from multiple scanlines. In the two dimensional image data, a column of pixels that is generated by a single optical detector in the optical sensor 54 in a plurality of scanlines is referred to as a "pixel column" in the image data. Each pixel column extends in the process direction.

Figure 5:
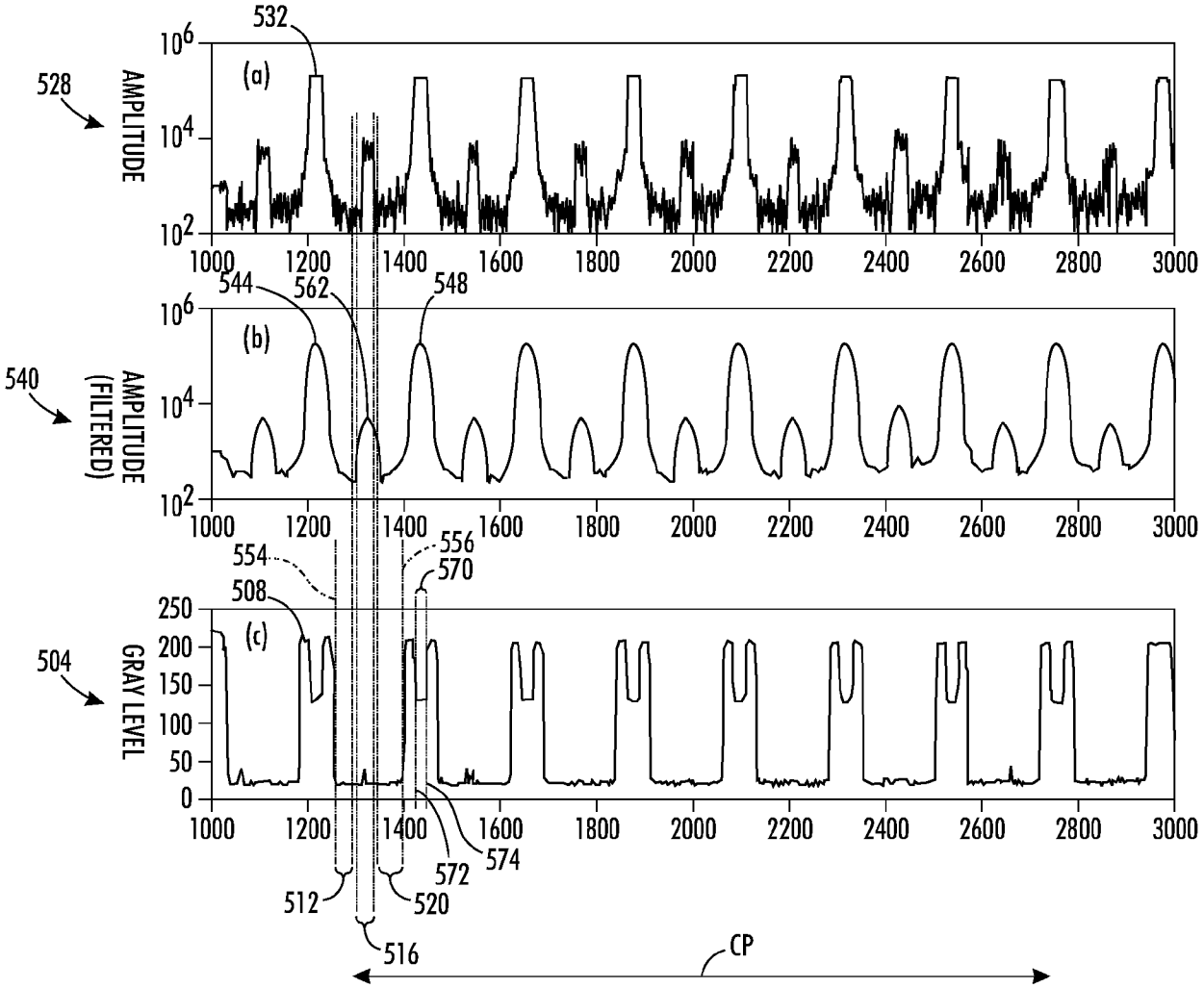
FIG. 5 is a depiction of graphs of image data, amplitude data, and filtered amplitude data corresponding to image data generated in a cross-process direction for cross-process direction printhead registration.

Process 100 continues with identification of the cross-process direction locations of the edges and centers of first printed marks that are formed on the image receiving surface using the high-contrast ink (block 114). Referring to FIG. 5, a graph 504 depicts a profile of the raw image data corresponding to a set of scanlines that averaged over the series of pixel columns that extends through printed marks that are similar to the marks depicted in FIG. 3A, FIG. 3B, and FIG. 4. The graph 504 depicts the reflectivity (gray level) of the image data in a profile with the highest numeric values, such as region 508, corresponding to the highly reflective bare media web 14. In the graph 504, the lines 554 and 556 correspond to cross-process direction edges of the high-contrast first printed mark, such as the strips 354A-354C or 404 in FIG. 3B and FIG. 4, respectively, or the line segments 304A-304C in FIG. 3A. The low-reflectivity regions 512 and 520 correspond to left-side and right-side margins in a high-contrast ink mark, such as a line segment or strip, which is printed on the media web 14. In addition to the edges of the strips, the graph 504 depicts reduced reflectivity regions corresponding to the high-contrast ink marks that are printed outside of the strips in FIG. 4. For example, the ink marks 412A-412N are printed with the high-contrast ink, such as black ink, on the high reflectivity image receiving surface. The image data 504 include reduced reflectivity regions, such as the region 570, corresponding to the printed marks. The lines 572 and 574 depict the cross-process direction edges of one of the printed marks 412A-412N.

During process 100, the controller 50 identifies the edges and centers of the first ink marks formed from the high-contrast ink directly from the image data. In one embodiment, the controller 50 identifies the cross-process direction edges of the first printed marks using a numeric reflectivity threshold. When the numeric reflectivity value of the image data fall below the threshold, such as at the edges 554 and 556 or at the edges 572 and 574, then the controller 50 identifies a location of an edge of one of the printed marks. The center of the mark is identified as a midpoint between the two edges in the image data. For example, the center of one of the printed strips is identified as the midpoint between the edges 554 and 556, and the center of one of the high-contrast ink marks is the midpoint between the edges 572 and 574. In another embodiment, the controller 50 identifies an average reflectivity level for the first ink marks over one or more scanlines and identifies the cross-process direction locations of the edges for each of the first ink marks at locations in the image data where the reflectivity begins to exceed the average value by greater than a predetermined threshold. For example, in the graph 504 pixel column locations 554 and 556 both correspond to the reflectivity values in the image data that greatly exceed the average reflectivity in the regions 512-520, which indicate that the pixel column locations 554 and 556 correspond to the cross-process direction locations of edges of a black strip in the image data.

Each pixel in the image data has a numeric value corresponding to a level of reflected light that the detector receives from the surface of the media web 14. When the media web 14 is white paper, the highest reflectivity values in the image data correspond to the bare surface of the paper, and the lowest reflectivity values correspond to black ink. The transparent ink marks that are located over the larger black ink marks have a slightly higher reflectivity than the areas of black ink alone, but the difference in reflectivity is insufficient to enable accurate identification of the cross-process direction locations of the transparent marks from the raw image data.

Referring again to FIG. 5, the central region 516 corresponds to the transparent mark that is formed over the black ink mark. In the graph 504, the transparent mark in the region 516 has a slightly higher reflectivity than the underlying black ink mark, but the relative difference in reflectivity is comparatively small compared to random noise generated in the image data, which makes accurate identification of the cross-process direction locations of the transparent ink marks difficult. Thus, the process 100 performs additional mathematical operations on the raw image data to enable accurate identification of the locations of the transparent ink marks on the media web 14.

Referring to FIG. 1 and FIG. 5, process 100 continues as the controller 50 applies a sequence of mathematical operations to the pixels in one or more scanlines of the image data to generate process direction amplitude profiles for multiple pixel columns in the image data to identify the locations of the low-contrast ink marks in the cross-process direction (block 116). In one embodiment, the controller 50 applies a convolution of periodic functions, such as sine and cosine functions, to the image data in along the scanlines corresponding to both the high-contrast and low-contrast inks to generate amplitude data corresponding to each of the pixels in a pixel column that extends in the process direction. The periodic functions are selected to have a period that corresponds to the expected process direction distance between the transparent marks formed on the media web 14. Because the periodic functions are selected with the period corresponding to the process direction spacing between the transparent ink marks, the amplitude profile has a different and stronger response to the image data corresponding to the low-contrast ink than the image data corresponding to regions of solid high-contrast ink that are not covered with the low-contrast ink, regions of the bare print medium, or regions of the print medium with a series of high-contrast ink marks. Thus, the amplitude profile that is generated from the image data more clearly differentiates the transparent ink marks, such as the transparent ink marks 408A-408N in FIG. 4, from the underlying black ink marks to improve the accuracy in identifying the cross-process direction locations of the transparent ink marks.

In FIG. 5, the graph 528 depicts the amplitude corresponding to the pixels in multiple scanlines of the image data that are depicted in the graph 504 after the controller 50 applies the convolution of the periodic functions to the image data. Each cross-process direction location in the graph 528 corresponds to the amplitude identified for a corresponding pixel column extending in the process direction through the printed test pattern 400 that is depicted in FIG. 4. As depicted in the graph 528, the highest amplitudes are measured in regions of the media that are located between the high-contrast ink strips, and the lowest amplitudes are measured in the left-side margin 512 and right-side margin 520. The region 516 corresponding to the transparent ink mark has an amplitude that is intermediate the other amplitudes already noted, which is more clearly distinguished from the surrounding black ink in the amplitude graph 528 than in the raw image data graph 504.

Process 100 continues as the controller 50 optionally applies a low-pass filter to the generated amplitude data (block 120). The low-pass filter removes high-frequency components from the amplitude data that typically correspond to noise, such as variations in the small interaction between the transparent ink and the black ink that gives rise to the small signal. In one embodiment, the low-pass filter is a box car filter with a box car profile that corresponds to the expected frequency of the transparent marks in the scanline. In FIG. 5, the graph 540 depicts the filtered amplitude data. The filtering amplitude data enable the controller 50 to identify the cross-process locations of the edges and centers of the printed marks formed with the black ink and the transparent ink more easily during the printhead registration process. Alternative embodiments omit the application of the low-pass filter if the noise levels in the amplitude data do not interfere with the identification of the locations of the printed marks in the cross-process direction.

Process 100 continues as the controller 50 identifies the centers of the printed marks formed with the low-contrast ink using the amplitude data (block 124). As described above, the controller 50 optionally uses the filtered amplitude data, such as the filtered amplitude data 540 from FIG. 5. In one embodiment, the controller 50 identifies peaks in the amplitude data, such as peak 562, which correspond to the center of the repeating pattern of the low-contrast ink marks. The low-contrast ink marks, such as the transparent ink marks depicted in FIG. 3A, FIG. 3B, and FIG. 4, are more clearly depicted in the amplitude data and filtered amplitude data than in the raw image data that are used to identify the cross-process direction locations of the high-contrast ink marks.

During process 100, the controller 50 identifies the cross-process direction offset between the color ink printhead and the transparent ink printhead with reference to an identified offset between the center of one or more of the first high-contrast ink marks and the center of one or more of the second low-contrast ink marks in the cross-process direction (block 128). As described above, the cross-process direction location of the center of the transparent ink mark is identified with reference to the cross-process direction location of the local maximum amplitude identified for the transparent ink mark, and the centers of the high-contrast ink marks are identified as the midpoints between the identified edges of the marks that are identified in the image data. The controller 50 converts the offset value identified in the image data to a physical measurement. For example, if each pixel in the image data corresponds to a cross-process direction width of approximately forty microns, then a ten pixel offset in the image data corresponds to a cross-process direction offset of approximately four-hundred microns between the two printheads.

In one embodiment of process 100, the controller 50 identifies the average cross-process direction offset between the center of each low-contrast ink mark and the corresponding high-contrast ink mark to identify the cross-process direction offset between the transparent ink printhead and the black ink printhead. For example, in FIG. 3A the controller 50 identifies an average cross-process direction distance between the centers of the black ink marks 304A-304C and the centers of the transparent ink marks 308A-308C. Similarly, the controller 50 identifies an average cross-process direction distance between the low-contrast ink marks 356A-356C, 358A-358C, and 360A-360C with the centers of the respective black ink strips 354A-354C in the printed pattern of FIG. 3B.

In another embodiment of process 100, the controller 50 identifies the cross-process direction distance between the centers of the high-contrast printed marks that are formed outside of the printed strips and the centers of the corresponding low-contrast second ink marks. For example, in FIG. 4 the controller 50 identifies the cross-process direction distance between the identified centers of the transparent ink mark 408A and the black ink mark 412A. The printed marks 408A and 412A are formed with a predetermined cross-process direction distance between the marks when the transparent ink printhead and black ink printhead that form the marks are registered in the cross-process direction. The controller 50 identifies a cross-process direction offset between the transparent ink printhead and the black ink printhead with reference to a deviation between the identified cross-process direction distance between the centers of the marks and the predetermined cross-process direction distance between the marks.

In one embodiment, the processing described above with reference to blocks 114-128 is performed for multiple scanlines of image data and the average cross-process direction offset identified for multiple printed marks on multiple scanlines is used to identify the cross-process direction offset between the transparent ink printhead and the corresponding black ink printhead. For example, in one embodiment the controller 50 performs the processing of blocks 114-128 for multiple image data scanlines that correspond to each of the transparent ink marks 356A-356C, 358A-358C, and 360A-360C as depicted in FIG. 3B. The identification of the relative locations between the centers of the black ink strips corresponding to multiple transparent ink marks reduces the effects of noise and random inkjet drop placement errors to increase the accuracy in identifying the cross-process direction offset between the transparent ink printhead and the black ink printhead.

If the identified cross-process direction offset between the transparent ink printhead and the corresponding color ink printhead is less than a predetermined threshold (block 132), then the printheads are considered to be in alignment and the printheads remain in their respective cross-process direction locations (block 136). If, however, the cross-process direction offset between the printheads is greater than the predetermined threshold (block 132), then the controller 50 operates one or more actuators to adjust the cross-process direction locations of the printheads to reduce or eliminate the cross-process direction offset (block 140).

Figure 8:
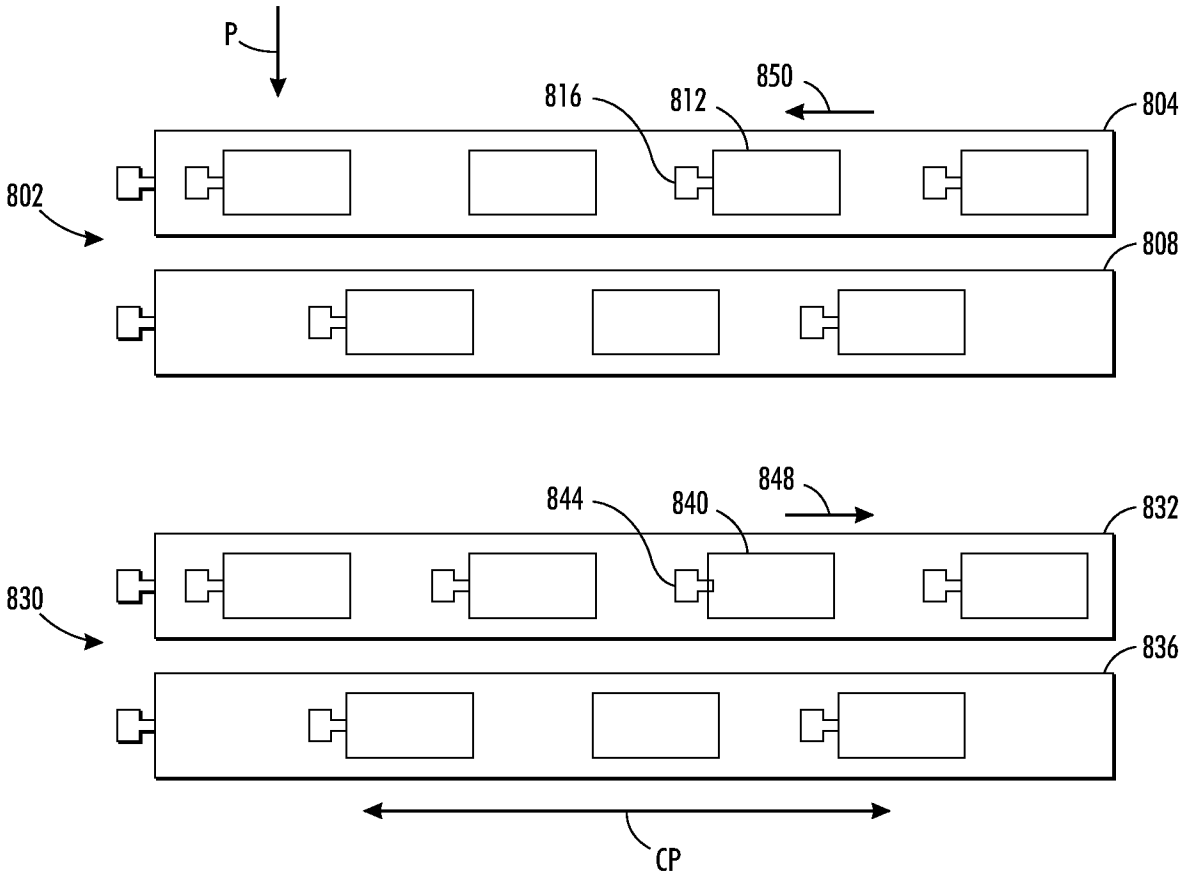
FIG. 8 PRIOR ART
FIG. 8 is a prior art schematic diagram of printheads that are arranged in the printer of FIG. 7.

FIG. 8 depicts an embodiment of a first printhead array 802 and a second printhead array 830 that include actuators that the controller 50 operates to correct identified cross-process direction offsets between corresponding printheads in process 100. The printhead array 802 includes two printhead bars 804 and 808. The printhead bar 804 supports a printhead 812 that is connected to an actuator 816. In the embodiment of FIG. 8, the actuator 816 is an electric stepper motor that is configured to adjust the location of the printhead 812 in the cross-process direction CP. The printhead array 802 includes printheads that eject black ink drops to form the color ink marks on the media web 14. A second printhead array 830 includes print bars 832 and 836 with printheads that eject drops of the transparent ink. In the printhead array 830, the printhead 840 corresponds to the printhead 812 in the printhead array 802.

In one configuration, the controller 50 operates another actuator 844 to move the printhead 840 in direction 848 to correct an identified cross-process direction offset between the printheads 812 and 840 that is depicted in FIG. 8. In another configuration, the controller 50 operates the actuator 816 to move the printhead 812 in direction 850 to correct the offset. In still another configuration, the controller 50 operates both actuators 816 and 844 to move both printheads 812 and 840, respectively, to correct the offset.

In one embodiment, the controller 50 performs process 100 for each corresponding pair of printheads in the transparent ink printhead unit 21E and one other printhead unit, such as the black ink printhead unit 21D, after the printheads in each of the color-ink printhead units 21A-21D have been registered in the cross-process direction using registration techniques that are known to the art. For example, if the black ink printhead 840 is already registered in the cross-process direction, the controller 50 only adjusts the cross-process direction of the transparent ink printhead 812 using the actuator 816 to register the transparent ink printhead 812 with the black ink printhead 840.

In another embodiment, the printer performs process 100 concurrently with another cross-process registration process for the color printheads. For example, the process 100 identifies a cross-process direction offset A between each transparent ink printhead and a corresponding color ink printhead. The printer 5 performs another cross-process direction registration process, which is known to the art and which identifies another cross-process direction offset B between the high-contrast color ink printhead and another high-contrast ink reference printhead in the print zone 20. The controller 50 then identifies the cross-process direction offset between the transparent ink printhead and the sum of the differences A and B, where A and B are directional vectors in the cross-process direction axis. For example, process 100 identifies that the transparent ink printhead 812 has a cross-process direction offset of +200 μm (200 μm to the right in FIG. 8) compared to the black ink printhead 840. The black ink printhead 840 has an offset of −100 μm (100 μm to the left in FIG. 8) compared to another reference printhead in the print zone 20. Process 100 identifies the total cross-process direction offset for the transparent ink printhead 812 as: 200 μm+(−100 μm)=100 μm from the reference printhead. The controller 50 operates the actuator 816 to move the printhead 812 in direction 850 by 100 μm and the controller 50 operates the actuator 844 to move the black ink printhead 840 in direction 848 by 100 μm to register both printheads with the reference printhead.

Process 100 registers each printhead in the transparent ink printhead unit 21E with a corresponding reference printhead with reference to the cross-process direction location of the corresponding color printhead in each of the CMYK printhead units 21A-21D. The printer 5 performs the cross-process direction registration process 100 in an iterative manner until the identified cross-process direction offsets between the transparent ink printheads in the printhead unit 21E and the color ink printheads in the printhead units 21A-21D are within the predetermined threshold.

While process 100 is described in conjunction with the printer 5 that is configured to print a transparent mark onto a white paper print medium, the process 100 is more widely applicable to cross-process direction registration between printheads that print a low-contrast ink and other printheads that print a high-contrast ink. For example, in an alternative configuration the printer 5 forms ink images on brown paper that is commonly used in packaging materials. In the alternative configuration, both the yellow ink printhead unit 21C and the transparent ink printhead unit 21E are low-contrast inks since the optical sensor 54 has difficulty in identifying ink drops of either yellow or transparent inks on the bare surface of the print medium. The printer 5 performs process 100 using, for example, cyan ink from the printheads in the printhead unit 21A to form underlying marks that are over-printed by the yellow ink printheads in the printhead unit 21C to form a high-contrast background for the yellow ink drops that enables cross-process direction registration for the yellow ink printheads. The process 100 is also performed for the transparent ink printheads in the printhead unit 21E using black ink from the black ink printhead unit 21D as a background in the same manner described above. More broadly, various alternative embodiments use process 100 to perform cross-process direction registration between printheads using a first printhead that prints high-contrast ink onto the image receiving surface followed by a second printhead that prints a low-contrast ink over the high-contrast ink marks.

Figure 2:
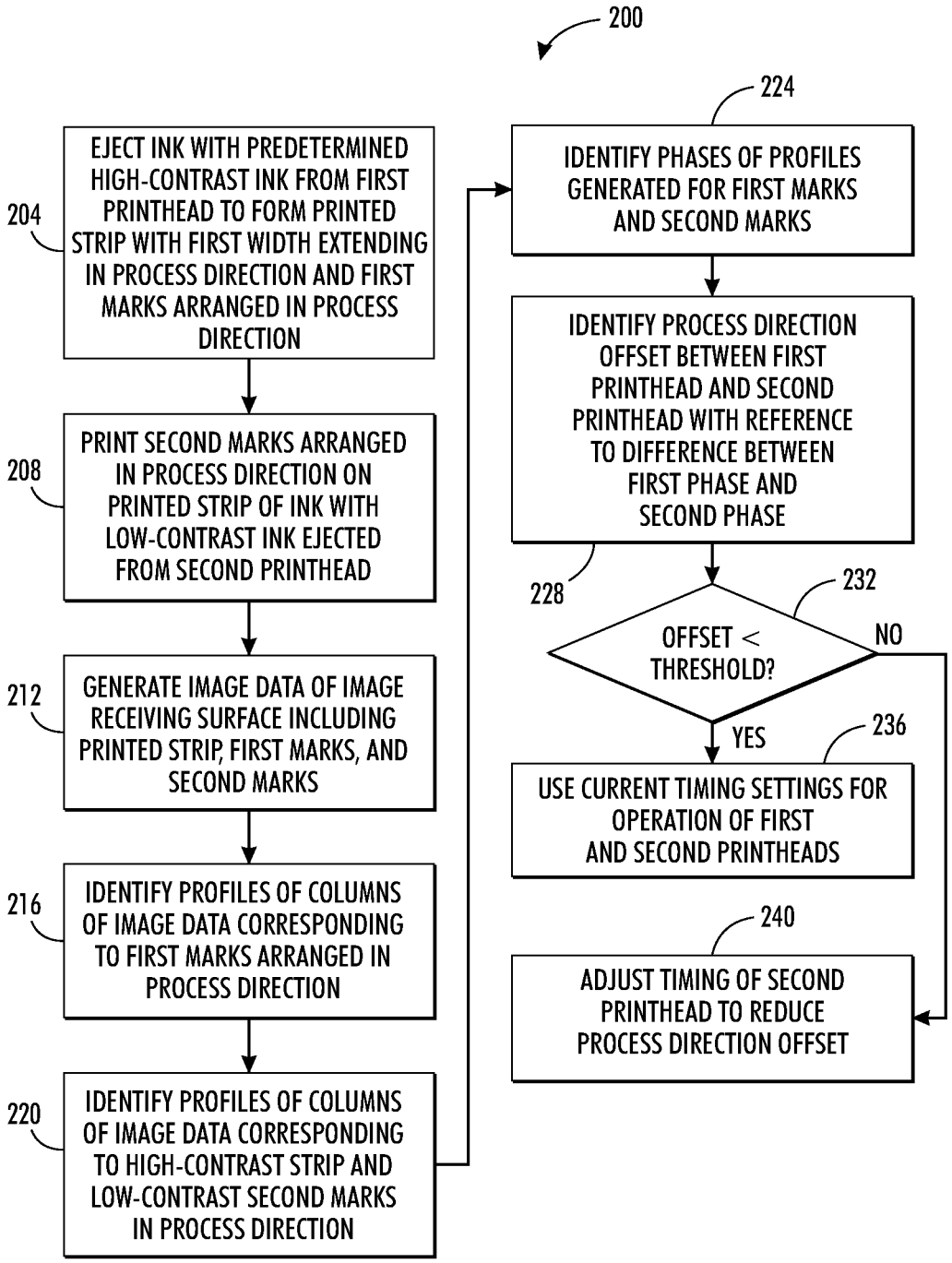
FIG. 2 is a block diagram of a process for performing process direction registration between printheads that print a low-contrast ink and printheads that print a high-contrast ink.

FIG. 2 depicts a process 200 for process direction printhead registration in a print zone that includes printheads that print ink having a high-contrast ink and printheads that print a low-contrast ink, such as transparent ink or a visible ink, which has a low-contrast with the image receiving surface. In the discussion below, a reference to the process 200 performing a function or action refers to a controller executing programmed instructions stored in a memory to operate one or more components in a printer to perform the function or action. Process 200 is described in conjunction with the printer 5 for illustrative purposes.

Process 200 begins as the controller 50 operates a plurality of inkjets in a printhead in one of the color printhead units 21A-21D to form printed marks with a predetermined high-contrast ink including at least one printed strip and a plurality of first printed marks that are located outside of the printed strip and extend in the process direction on the media web 14 (block 204). In the illustrative embodiment of the printer 5, the media web 14 is white paper and the black ink is a high-contrast ink that is easily detectable on the surface of the white paper. The printed strip is formed with a predetermined width in the cross-process direction and a predetermined length in the process direction that is longer than the width. The controller 50 also operates a corresponding printhead in the transparent ink printhead unit 21E to form a series of second ink marks using the transparent ink on each strip of a high-contrast ink that is formed by the color ink printhead (block 208).

Referring again to FIG. 4, the marks 400 include black ink and transparent ink marks that are formed during the processing described above with reference to the blocks 204 and 208. In particular, the black ink marks, such as the marks 412A-412N, are printed along with the black ink strips, such as the ink strip 404. Each set of the transparent ink marks, such as the marks 408A-408N, are printed over a corresponding black ink strip. In FIG. 4, the transparent ink marks 408A-408N are formed with the same shape, size, and process direction separation as the black ink marks 412A-412N. As depicted in FIG. 4, however, the transparent ink marks 408A-408N are offset from the black ink marks 412A-412N in the process direction P by an offset distance 440 when the black ink printhead and transparent ink printhead are not registered in the process direction. As described below, the process 200 identifies the offset between the black ink marks and transparent ink marks to identify a process direction offset between the corresponding transparent ink and black ink printheads.

Referring again to FIG. 2, process 200 continues as the controller 50 generates image data of the printed black ink strips, black ink marks, and transparent marks on the media web 14 (block 212). In the printer 5, the controller 50 and the optical sensor 54 generate the image data in substantially the same manner as described above with reference to the processing of block 112 in the process 100. The generated image data include pixel columns that extend through the black ink strips and transparent ink marks and additional pixel columns that extend through the printed black ink marks. For example, in FIG. 4 the arrow 432 indicates a pixel column of image data, which is generated by a single detector in the optical sensor 54, extending through the black ink strip 404 and the transparent ink marks 408A-408N. The arrow 436 indicates another pixel column of image data, which is generated by another detector in the optical sensor 54, extending through portions of the bare surface of the media web 14, and through the black ink marks 412A-412N.

Figure 6:
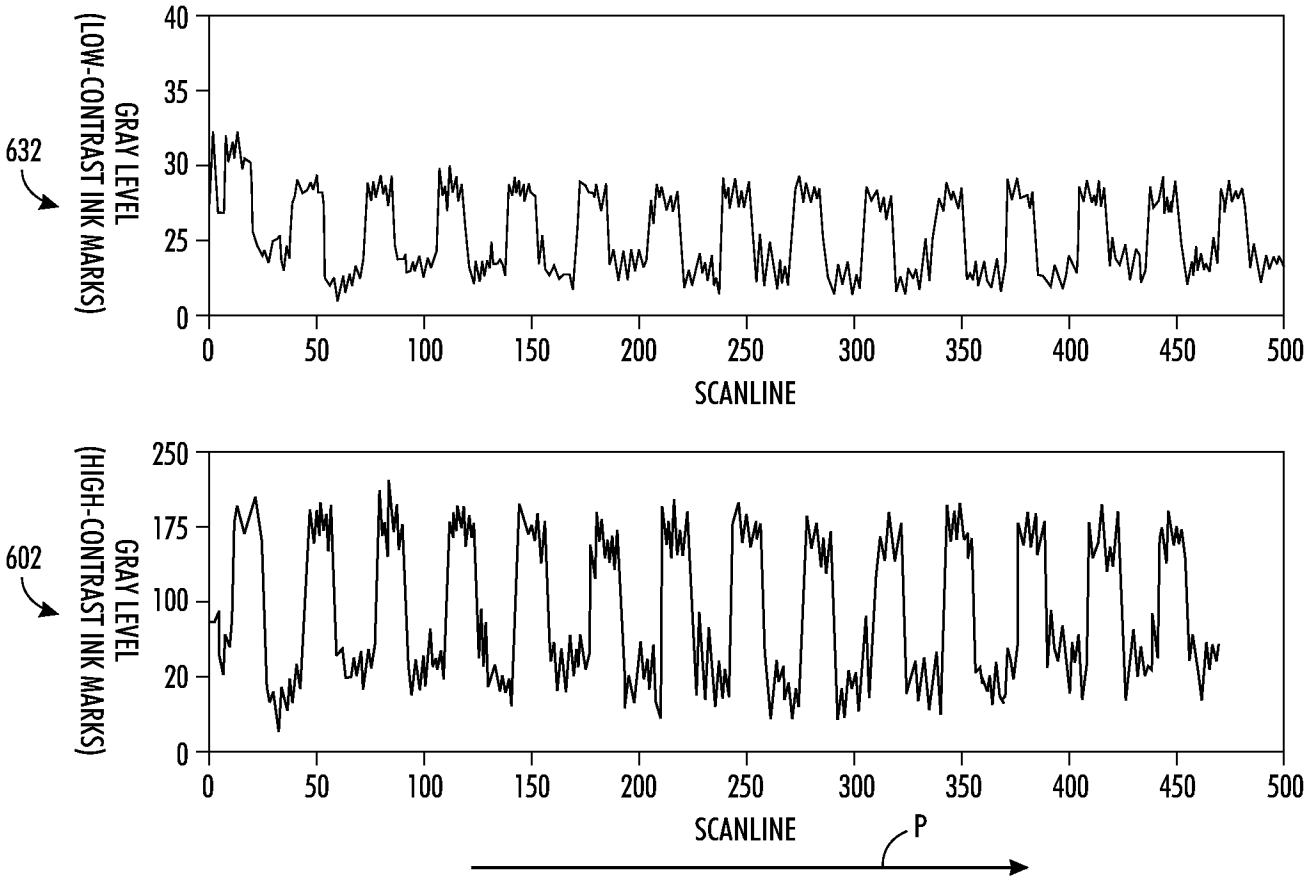
FIG. 6 is a depiction of sets of image data generated in the process direction for process direction printhead registration.

Once the optical sensor 54 generates the image data, process 200 continues as the controller 50 identifies a profile for a pixel column that extends through the image data corresponding to the first printed marks 412A-412N in the process direction (block 216). FIG. 6 includes a graph 602 that depicts a profile of the image data through a pixel column, such as the pixel column along the line 436 in FIG. 4. In the graph 602, the peaks correspond to blank portions of the surface of the media web 14 and the troughs, such as trough 604, correspond to the black ink of the first marks 412A-412N formed on the media web 14. The first marks are formed with a predetermined size and a predetermined distance d separates consecutive marks in the process direction P. In some embodiments, the controller 50 averages values from multiple adjacent pixel columns and applies filters, such as a low-pass boxcar filter, to the profile data to remove noise from the profile data corresponding to the first marks 412A-412N.

During process 200, the controller 50 also identifies profiles for pixel columns that extend through the image data corresponding to the second printed marks 408A-408N in the process direction (block 220). As described above in the process 100, the controller 50 identifies these pixel columns from the amplitude plot in FIG. 5. FIG. 6 depicts a graph 632 of the gray levels along the strip 404 and transparent marks 408A-408N that correspond to the pixel column 432 in the process direction P. In the profile graph 632, the peaks, such as peak 634, correspond to the regions of the profile that include the transparent ink marks, and the troughs represent regions of the profile that are over the black ink strip 404 between the marks 408A-408N. In the graph 632, the peaks and troughs are clearly identifiable, but in some embodiments the contrast is small and the peaks and troughs cannot be clearly identified. In different embodiments of the process 200, the controller 50 identifies the profiles for the marks 408A-408N and 412A-412N in any order or concurrently.

Process 200 continues as the controller 50 identifies the phase for both of the profiles generated for the black ink marks and the transparent ink marks (block 224). The first phase $\phi_C$ corresponds to the phase of the profile for the first black ink marks 412A-412D, and the second phase $\phi_T$ corresponds to the phase of the profile for the second transparent ink marks 408A-408N that are printed on the strip 404. The phase is defined using the following equation:

$$\phi = \tan^{-1}\frac{\sum_i p_i \cos\frac{2\pi i}{s}}{\sum_i p_i \sin\frac{2\pi i}{s}}$$

where $p_i$ is the reflectivity value at scanline index i in either profile graph 602 or 632, and s is the predetermined number of scanlines in the process direction P that separate the centers of consecutive marks in the series of marks 408A-408N and 412A-412N.

After identifying the phases $\phi_T$ and $\phi_C$ that correspond to the profile data for the marks 408A-408N and 412A-412N, respectively, the controller 50 identifies a process direction offset between the black ink marks 412A-412N and the transparent ink marks 408A-408N with reference to a difference between the two phases $\phi_T$ and $\phi_C$, respectively (block 228). The controller 50 identifies the process direction offset using the following equation:

$$\Delta y = \left(\frac{\phi_T - \phi_C}{2\pi}\right) sr,$$

where s is the predetermined number of scanlines between the printed marks 408A-408N and 412A-412N in the process direction and r is a predetermined linear dimension of a region of the media web 14 corresponding to the size of each scanline in the process direction, which is typically one the order of several microns. Thus, the value Δy corresponds to a linear dimension of the process direction offset 440 between the transparent ink marks 408A-408N and each of the corresponding black ink marks 412A-412N.

If the identified process direction offset Δy is within a predetermined offset threshold (block 232), then the transparent ink printhead and corresponding color ink printhead are already registered with sufficient accuracy in the process direction, and the printer 5 continues to operate the printheads using current timing settings (block 236). If, however, the process direction offset Δy exceeds the predetermined offset threshold (block 232), then the controller 50 adjusts a timing value that is used to operate the inkjets in the second printhead to reduce the process direction offset (block 240). For example, if the offset Δy indicates that the transparent marks 408A-408N are delayed in the process direction from the corresponding black ink marks 412A-412N, then the controller 50 identifies a timing delay with reference to the offset Δy and the predetermined linear velocity of the media web 14. The controller 50 stores the timing delay value in the memory 52 to delay the time at which firing signals are generated for the inkjets in the transparent ink printhead. If the offset Δy indicates that the black ink marks 412A-412N are delayed in the process direction from the transparent marks 408A-408N, then the controller 50 identifies an amount of time to advance the operation of the inkjets in the transparent ink printhead with reference to the offset Δy and the predetermined linear velocity of the media web 14. The controller 50 stores the updated timing value in the memory 52. The printer 5 performs the process direction registration process 200 in an iterative manner until the identified process direction offsets between the transparent ink printheads in the printhead unit 21E and the color ink printheads in the printhead units 21A-21D are within the predetermined threshold.

While process 200 is described in conjunction with the printer 5 that is configured to print a transparent ink onto a white paper print medium, the process 200 is more widely applicable to process direction registration between printheads that print a low-contrast ink and other printheads that print a high-contrast ink in a printer. For example, in an alternative configuration the printer 5 forms ink images onto brown paper that is commonly used in packaging materials. In the alternative configuration, both the yellow ink printhead unit 21C and the transparent ink printhead unit 21E are low-contrast inks since the optical sensor 54 has difficulty in identifying ink drops of either yellow or transparent inks on the bare surface of the print medium. The printer 5 performs process 200 using, for example, cyan ink from the printheads in the printhead unit 21A to form underlying marks that are over-printed by the yellow ink printheads in the printhead unit 21C to form a high-contrast background for the yellow ink drops that enables process direction registration for the yellow ink printheads. The process 200 is also performed for the transparent ink printheads in the printhead unit 21E using black ink from the black ink printhead unit 21D as a background in the same manner described above. More broadly, various alternative embodiments use process 200 to perform process direction registration between printheads using a first printhead that prints high-contrast ink onto the image receiving surface followed by a second printhead that prints a low-contrast ink over the high-contrast ink marks.

It will be appreciated that variants of the above-disclosed and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed:

1. A method of registering printheads in an inkjet printer comprising:

operating a plurality of inkjets in a first printhead to eject a plurality of ink drops of a high-contrast ink onto an image receiving surface to cover a continuous area of the image receiving surface to form a continuous strip comprised of the high-contrast ink drops, the continuous area of the strip having a first predetermined width in a cross-process direction and a length in a process direction that is longer than the first predetermined width;

operating a plurality of inkjets in a second printhead to eject a plurality of ink drops of a low-contrast ink to cover a portion of the continuous area covered with the plurality of the high-contrast ink drops with a plurality of areas of the low-contrast ink within the continuous area of the continuous strip, each area of the low-contrast ink in the portion of the continuous area covered with low-contrast ink drops having a second predetermined width in the cross-process direction that is less than the first predetermined width to form a first margin of high contrast ink adjacent one side of the portion of the continuous area having the second predetermined width and to form a second margin of high contrast ink adjacent a second side of the portion of the continuous area having the second predetermined width and each area of low-contrast ink being separated from another area of the low-contrast ink in the process direction by the high-contrast ink drops within the continuous area of the continuous strip not covered by the low-contrast ink;

generating image data corresponding to a portion of the image receiving surface;

applying a sequence of mathematical operations to the generated image data, the sequence of mathematical operations defined to respond differently to a recurrence of the areas of low-contrast ink within the continuous area of the continuous strip in the cross-process direction;

identifying a center of the continuous strip in the cross-process direction and a center of the low-contrast ink in the plurality of areas of low-contrast ink within the continuous area of the continuous strip in the cross-process direction with reference to an amplitude for each application of the sequence of mathematical operations to the generated image data;

identifying a position corresponding to the plurality of high-contrast ink drops in the cross-process direction with reference to the generated image data and the identified center of the continuous strip;

identifying a position corresponding to the plurality of low-contrast ink drops in the cross-process direction with reference to the generated image data and the identified center of the low-contrast ink in the plurality of areas of low-contrast ink;

identifying a cross-process direction offset between the first printhead and the second printhead with reference to a cross-process direction distance between the identified position of the plurality of the high-contrast ink drops and the identified position of the plurality of low-contrast ink drops; and operating an actuator to move the second printhead with reference to the identified cross-process direction offset.

2. The method of claim 1 further comprising:

spreading the plurality of the high-contrast ink drops and the plurality of low-contrast ink drops prior to generation of the image data.

3. The method of claim 1, the application of the sequence of mathematical operations further comprising:

convolving a periodic function with the generated image data, the periodic function having a period corresponding to the recurrence of the areas of the low-contrast ink within the strip in the cross-process direction; and identifying the center of the continuous strip in the cross-process direction and the center of the low-contrast ink in the plurality of areas of low-contrast ink within the continuous area of the continuous strip in the cross-process direction with reference to an amplitude for each convolution of the periodic function with the generated image data.

4. The method of claim 3 further comprising:

filtering each convolution of the periodic function with the generated image data for each detector to remove high frequency components.

5. The method of claim 4 wherein the filter is a box car filter.

6. The method of claim 1, the high-contrast ink being black ink.

7. The method of claim 1, the low-contrast ink being transparent ink.

8. The method of claim 1, the high-contrast ink being a phase change ink and the low-contrast ink being a phase change ink.

9. A method of registering printheads in an inkjet printer comprising:

operating a plurality of inkjets in a first printhead to eject a plurality of ink drops of a high-contrast ink onto an image receiving surface to cover a continuous area of the image receiving surface having a first predetermined width in a cross-process direction and form a plurality of areas of the high-contrast ink drops outside of the continuous area of the continuous strip on the image receiving surface, the continuous area of the continuous strip being defined by the first predetermined width in the cross-process direction and a length in a process direction that is longer than the first predetermined width, and each area of the high-contrast ink in the plurality of areas of high-contrast ink outside of the continuous area of the continuous strip having the second predetermined width in the cross-process direction and being separated from another area of the high-contrast ink in the plurality of areas of high-contrast ink outside of the continuous area of the continuous strip in the process direction by a predetermined length;

operating a plurality of inkjets in a second printhead to eject a plurality of ink drops of a low-contrast ink to cover a portion of the continuous area covered with the plurality of the high-contrast ink drops, the portion of the continuous area covered with low-contrast ink drops having a second predetermined width in the cross-process direction that is less than the first predetermined width to form a first margin of high contrast ink adjacent one side of the portion of the continuous area having the second predetermined width and to form a second margin of high contrast ink adjacent a second side of the portion of the continuous area having the second predetermined width and form a plurality of areas of the low-contrast ink within the continuous area of the continuous strip, each area of the low-contrast ink in the continuous area of the continuous strip having the second predetermined width and being separated from another area of the low-contrast ink within the continuous area in the continuous strip in the process direction by the high-contrast ink drops within the continuous area of the continuous strip not covered by the low-contrast ink;

generating image data corresponding to a portion of the image receiving surface using a plurality of detectors arranged in a cross-process direction across the image receiving surface;

identifying a position corresponding to the plurality of high-contrast ink drops in the cross-process direction with reference to the generated image data;

identifying a position corresponding to the plurality of low-contrast ink drops in the cross-process direction with reference to the generated image data;

identifying a cross-process direction offset between the first printhead and the second printhead with reference to a cross-process direction distance between the identified position of the plurality of the high-contrast ink drops and the identified position of the plurality of low-contrast ink drops;

operating an actuator to move the second printhead with reference to the identified cross-process direction offset;

identifying a first profile for each detector generating image data for a portion of the continuous strip having the predetermined length in the process direction and in which the low-contrast ink has been ejected;

identifying a second profile for each detector generating image data for a portion of the image receiving surface having the predetermined length in the process direction and in which the high-contrast ink has been ejected;

identifying a phase of the first profile and a phase of the second profile;

identifying a process direction offset between the first printhead and the second printhead with reference to the identified phase of the first profile and the identified phase of the second profile; and operating at least one of the first printhead and the second printhead with reference to the identified process direction offset.

10. The method of claim 9, the identification of the process direction offset further comprising:

identifying a difference between the identified phase of the first profile and the identified phase of the second profile.

11. A method of registering printheads in an inkjet printer comprising:

operating a plurality of inkjets in a first printhead to eject high-contrast ink into a continuous area to form a continuous strip comprised of ink drops of a high-contrast ink and to form a plurality of areas of the high-contrast ink drops outside of the continuous area of the continuous strip on an image receiving surface, the continuous area of the continuous strip being defined by a first predetermined width in a cross-process direction and a length in a process direction that is longer than the first predetermined width, and each area of the high-contrast ink in the plurality of areas of high-contrast ink outside of the continuous area of the continuous strip having a second predetermined width and being separated from another area of the high-contrast ink in the plurality of areas of high-contrast ink outside of the continuous area of the continuous strip in the process direction by a predetermined length, the second predetermined width being less than the first predetermined width;

operating a plurality of inkjets in a second printhead to form a plurality of areas of a low-contrast ink within the continuous area of the continuous strip, each area of the low-contrast ink in the continuous area of the continuous strip having the second predetermined width and being separated from another area of the low-contrast ink in the continuous area of the continuous strip in the process direction by the high-contrast ink drops within the continuous area of the continuous strip not covered by the low-contrast ink;

generating image data of a portion of the image receiving surface using a plurality of detectors arranged in a cross-process direction across the image receiving surface;

identifying a first profile for each detector generating image data for a portion of the continuous area of the continuous strip having the predetermined length in the process direction and in which the low-contrast ink has been ejected;

identifying a second profile for each detector generating image data for a portion of the image receiving surface having the predetermined length in the process direction and in which the high-contrast ink has been ejected;

identifying a phase of the first profile and a phase of the second profile;

identifying a process direction offset between the first printhead and the second printhead with reference to the identified phase of the first profile and the identified phase of the second profile; and operating at least one of the first printhead and the second printhead with reference to the identified process direction offset.

12. The method of claim 11, the identification of the process direction offset further comprising:

identifying a difference between the identified phase of the first profile and the identified phase of the second profile.

13. The method of claim 11, the operation of the plurality of inkjets in the second printhead further comprising:

operating the inkjets in the second printhead to form each area in the plurality of areas with a rectangular shape.

14. The method of claim 11, the high-contrast ink being black ink.

15. The method of claim 11, the low-contrast ink being transparent ink.

16. The method of claim 11, the high-contrast ink being a phase change ink and the low-contrast ink being a phase change ink.

* * * * *